United States Patent [19]

Leonard

[11] Patent Number: 4,655,154

[45] Date of Patent: Apr. 7, 1987

[54] COLLAPSIBLE MAST ASSEMBLY

[76] Inventor: James B. Leonard, 324 N. Oxford Ave., Ventnor, N.J. 08406

[21] Appl. No.: 822,997

[22] Filed: Jan. 27, 1986

[51] Int. Cl.[4] ..... B63B 15/00

[52] U.S. Cl. ..... 114/91; 114/93

[58] Field of Search ..... 114/39, 89–94, 114/97–99, 187; 116/173; 52/116, 146, 720; 212/183

[56] References Cited

U.S. PATENT DOCUMENTS

| | | | |
|---|---|---|---|
| 145,648 | 12/1873 | Hammond | 114/91 |
| 197,980 | 12/1877 | Robbins | 114/93 |
| 282,592 | 8/1883 | Walthour | 114/93 |
| 413,336 | 10/1889 | Couch | 114/93 |
| 477,477 | 6/1892 | Uhlig | 114/91 |
| 2,673,543 | 3/1954 | Plym | 114/98 |
| 3,792,680 | 2/1974 | Allen | 114/187 |
| 4,112,861 | 9/1978 | Lewis | 114/91 |
| 4,259,917 | 4/1981 | Frank | 114/91 |
| 4,453,482 | 6/1984 | Barker | 114/93 |

FOREIGN PATENT DOCUMENTS

| | | | |
|---|---|---|---|
| 2496046 | 6/1982 | France | 114/90 |
| 127278 | 10/1980 | Japan | 114/93 |

*Primary Examiner*—Galen Barefoot
*Assistant Examiner*—Stephen P. Avila
*Attorney, Agent, or Firm*—Norman E. Lehrer

[57] ABSTRACT

A collapsible mast assembly for a sailboat includes a mast support which is mounted on the boat deck for supporting the lower end of the mast. The support includes upstanding side walls and a lower rear wall to which the boom is attached. A mast plate is mounted within the mast support at the bottom thereof and is adapted to fit within the open lower end of the tubular mast. The mast is lowered by loosening its stays and then lifting the same until its bottom is above the level of the mast plate. At that point the mast can be tilted backward toward a horizontal position where it rests and pivots on the top of the rear wall as the bottom of the mast pivots upwardly through the open front of the mast support. In the horizontal position, the mast can be moved rearwardly or forwardly as desired. The boom is secured to the rear of the mast support so that movement of the mast is independent of the boom.

8 Claims, 10 Drawing Figures

COLLAPSIBLE MAST ASSEMBLY

BACKGROUND OF THE INVENTION

The present invention is directed toward a collapsible mast assembly for a sailboat and, more particularly, toward such an assembly which supports the mast but which allows the same to be raised and lowered quickly and easily with the sail, boom, halyard, etc. in place at all times.

Various arrangements have been proposed in the past to provide a sailboat with a mast which can be easily moved between an upright operative position and a substantially horizontal inoperative position in order to facilitate the transporting of the sailboat by a trailer or the like. In the majority of these prior systems such as shown in U.S. Pat. Nos. 145,648; 477,477; 4,112,861; 4,259,917 and 4,453,482, the mast is hinged to a base plate or to a support member which is fixed or hinged to a base plate and the mast is raised or lowered by pivoting the same with respect to the base plate or support member. While such systems may be of some benefit, they have generally been relatively complex. Furthermore, only pivotal movement of the mast is possible. When the mast is in its horizontal position, it cannot be moved linearly without disconnecting the pivot means. As a result, a relatively long mast may extend too far past the stern of the boat. Even further, when the mast is pivoted to a support member, the support member must be strong enough to support the mast and the great forces applied thereto when the wind hits the sail.

U.S. Pat. No. 282,592 shows a system for supporting a mast wherein the mast passes through a ring which is pivoted to the thwart or hood of a sailboat and the lowermost end of the mast fits into a step connected to the bottom or keel of the boat. The mast is lowered into its inoperative position by lifting the same slightly to remove the bottom of the mast from the step and then tilting the mast backward as the ring pivots. In its horizontal position, some limited linear movement of the mast is possible although it is somewhat limited since the bottom of the mast is within the interior of the boat and, therefore, can be moved forwardly only a very small amount. Furthermore, the boom of this patent is connected directly to the mast and accordingly the same must be disconnected before the mast can be pivoted into its inoperative position.

SUMMARY OF THE INVENTION

The present invention is designed to overcome all of the deficiencies of the prior art described above. The collapsible sailboat mast assembly of the invention includes a mast support which is mounted on the boat deck for supporting the lower end of the mast. The support includes upstanding side walls and a lower rear wall to which the boom is attached. A mast plate is mounted within the mast support at the bottom thereof and is adapted to fit within the open lower end of the tubular mast. The mast is lowered by loosening its stays and then lifting the same until its bottom is above the level of the mast plate. At that point the mast can be tilted backward toward a horizontal position where it rests and pivots on the top of the rear wall as the bottom of the mast pivots upwardly through the open front of the mast support. In the horizontal position, the mast can be moved rearwardly or forwardly as desired. The boom is secured to the rear of the mast support so that movement of the mast is independent of the boom. This arrangement allows the sail to be rigged to the mast and boom at all times thereby saving considerable time in rerigging.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 1:
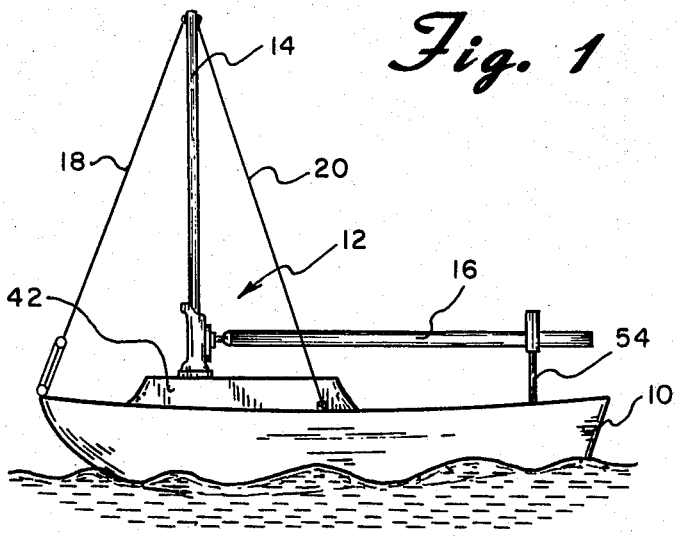
FIG. 1 is an elevational view of a sailboat equipped with a collapsible mast assembly constructed in accordance with the principles of the present invention.
Figure 3:
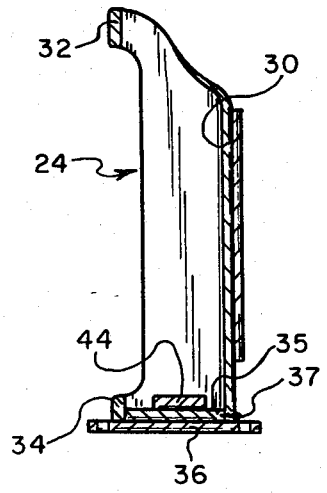
FIG. 3 is a cross-sectional view taken through the line 3—3 of FIG. 2.
Figure 2:
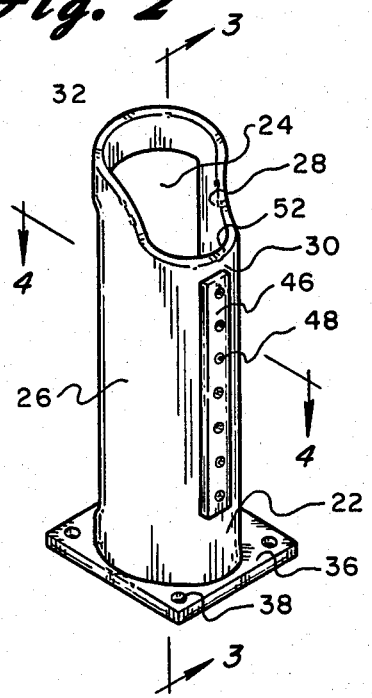
FIG. 2 is a perspective view of a mast support which constitutes a significant part of the invention.
Figure 6:
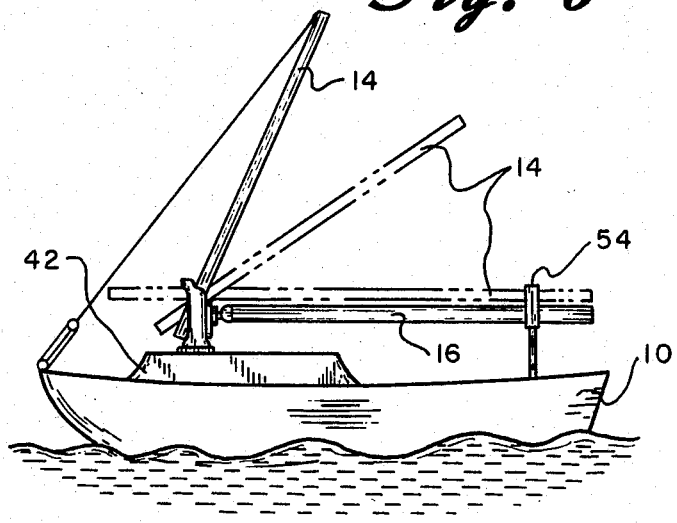
FIG. 6 is a view similar to FIG. 1 showing the manner in which the mast is lowered.

Referring now to the drawings in detail wherein like reference numerals have been used throughout the various figures to designate like elements, there is shown in FIGS. 1 and 6 a sailboat 10 being equipped with a collapsible mast assembly designated generally as 12. The sailboat 10 is equipped with a substantially tubularly shaped mast 14 and a boom 16 both of which are, per se, known in the art. Accordingly, a detailed description of the mast 14 and boom 16 are not believed necessary. The mast 14 is normally maintained in its upright position as shown in FIG. 1 through the use of fore-and-aft stays 18 and 20.

Figure 5:
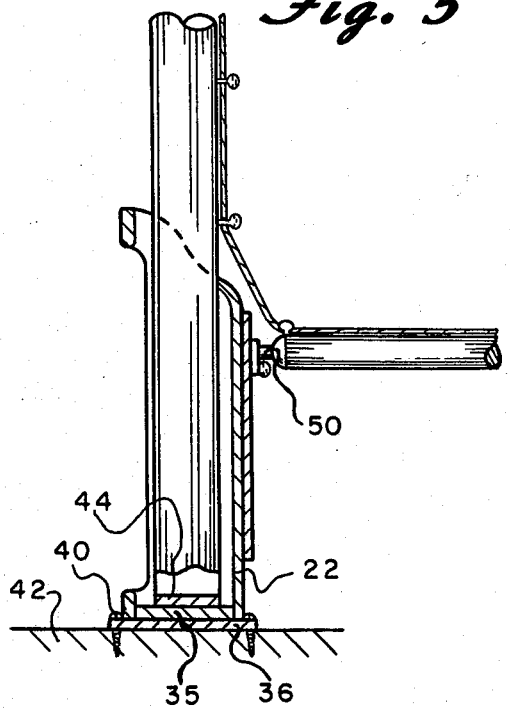
FIG. 5 is a view similar to FIG. 3 but showing the mast support being connected to a boom and supporting the base of a mast.
Figure 4:
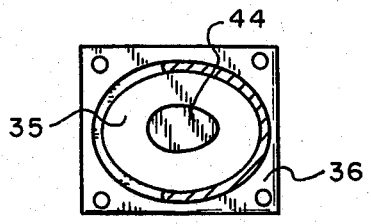
FIG. 4 is a cross-sectional view taken through the line 4—4 of FIG. 2.

As shown most clearly in FIG. 5, the lower end of the mast 14 is supported by a mast support 22. Mast support 22 is substantially tubularly shaped although it is substantially open at the front as shown at 24. While the mast support 22 is tubularly shaped, it can be considered to include side walls 26 and 28 and a rear wall 30. These walls are spaced apart a sufficient distance from each other; that is, the diameter of the tubular member which makes up the side walls is great enough so as to allow the mast 14 to be freely movable in a vertical direction into and out of the support 22.

For reasons which will become clearer hereinafter, the rear wall 30 of the mast support 22 is lower than the height of the side walls 26 and 28. In addition, the forward upper ends of the side walls 26 and 28 are connected together by a wall 32. Again, the wall 32 is actually a part of the cylindrical member which makes up the remaining parts of the walls. In actuality, the mast support 22 thus far described is constructed by starting with a tubular member and then cutting out the front thereof to form the opening 24 and cutting the top to reduce the height of the lower back wall 30 and to form the configuration shown in the figures. A partial lower front wall 34 may also be left remaining to add rigidity and to prevent possible accidental movement of the base of the mast 14.

A plate 35 is secured to the inside bottom of the walls 26, 28 and 30 by welding or by any other known technique such as by the use of screws 37. The plate 35 is, in turn, bolted or welded to base plate 36 which has a plurality of holes 38 passing therethrough which, through the use of screws 40, secures the mast support 22 to the deck 42 of a ship or to some other suitable surface thereof.

Mounted on the upper surface of the plate 35 and within the interior of the mast support 22 is a mast plate 44. The outer dimensions or periphery of the mast plate 44 are complementary to but smaller than the inner dimension of the base of the mast 14 so that the mast can fit over the mast plate as shown in FIG. 5. As a result, the lateral movements of the base of the mast 14 are restricted by the mast plate. Of course, if a solid mast is utilized, the mast plate could have a complementary recess therein into which the bottom of the mast may be inserted.

A connecting strip 46 having a plurality of openings 48 therein is secured to the outer surface of the rear wall 30. The forward end of the boom 16 can be connected to the strip 46 at any one of a plurality of different vertical positions through the use of a pivot joint 50 which connects to one of the openings 48.

The mast assembly described above functions in the following manner. As shown in FIG. 1, the mast 14 is in its vertical operative position. The lowermost portion of the mast bears on the plate 35 and surrounds the mast plate 44. The mast is maintained in its proper vertical position by the mast and base plates and by the fore-and-aft stays 18 and 20. In its proper vertical position, the mast 14 will never contact the walls of the mast support 22. However, should the stays loosen thereby allowing the mast to lift slightly and become disengaged from the mast plate 44, the base of the mast 14 would still remain within the lower part of the tubular member and would be surrounded by the walls 26, 28, 30 and 40.

Whenever it is desired to lower the mast 14, the stays 18 and 20 are either removed or can simply be loosened somewhat. The mast is then lifted vertically slightly until the bottom is above the height of the mast plate 44. At this time, the mast can be tilted backwardly as it rests and is pivoted on the top or upper edge 52 of the rear wall 30. As the mast is pivoted backwardly, the bottom of the mast pivots upwardly through the opening 24 at the front of the mast support 22.

Figure 7:
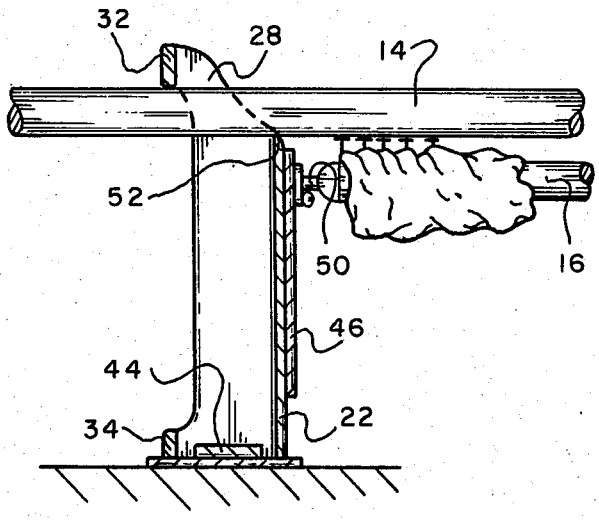
FIG. 7 is a view similar to FIG. 5 but showing the mast in its lowered inoperative position.

The procedure for lowering the mast just described is, perhaps, best illustrated in FIG. 6 wherein the mast is shown in various degrees of being lowered. The fully lowered position is illustrated in FIG. 7. The mast 14 rests on the top edge 52 of the rear wall 30, its sideward movement is restricted by the side walls 26 and 28 and the front wall or connecting means 32 prevents the mast 14 from moving upwardly. The mast can, however, move forwardly or rearwardly to any desired position since it is not secured to the mast support 22 by any fixed or pivotal means. It should be noted that since the boom 16 is secured to the mast support 22 rather than to the mast itself, the mast can be raised and lowered with the boom 16 in place. It is not necessary to connect or disconnect the boom. Furthermore, it is not necessary to ever disconnect the sail. Even further, when the mast is in its covered position, the support 22 in combination with the rear support 54 (FIGS. 1 and 6) functions as a mast carrier.

Figure 8:
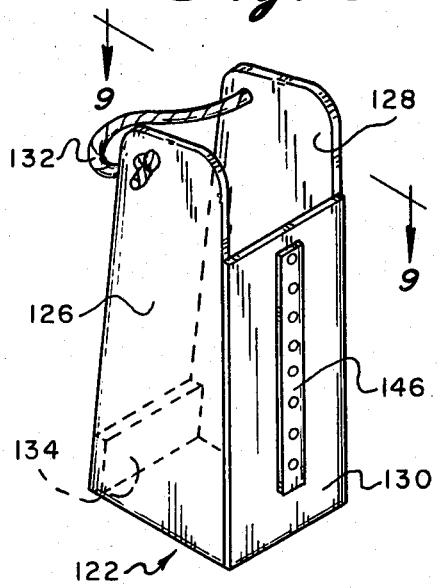
FIG. 8 is a perspective view similar to FIG. 2 of a second embodiment of a mast support.
Figure 10:
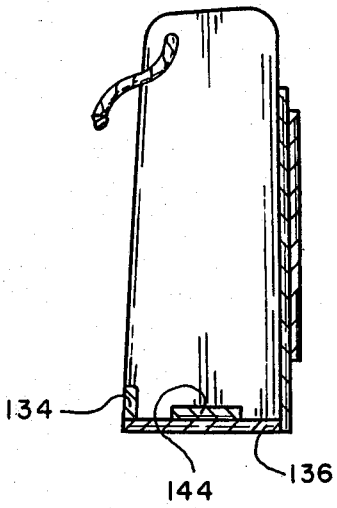
FIG. 10 is a cross-sectional view taken through the line 10—10 of FIG. 9.
Figure 9:
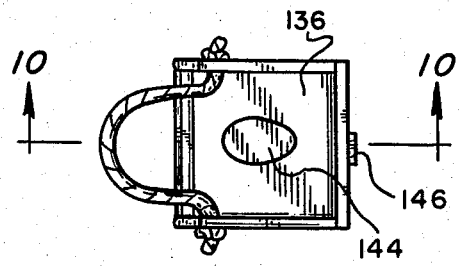
FIG. 9 is a cross-sectional view taken through the line 9—9 of FIG. 8.

A modified form of the mast support 22 is shown in FIGS. 8, 9 and 10 and is designated generally as 122. Mast support 122 includes substantially planar side walls 126 and 128, a substantially planar rear wall 130 and a partial front wall 134. Thus, the configuration of the mast support 122 is substantially box-shaped. As with the first embodiment, the rear wall 130 is shorter than the side walls 126 and 128 and a connecting means 146 is secured to the rear wall 130 for connecting the same to a boom. As shown most clearly in FIGS. 9 and 10, the bottoms of the walls 126, 128 and 130 are secured to a base plate 136 and a mast plate 144 is mounted on the base plate 136. The upper forward ends of the side walls 126 and 128 are connected together by means of a flexible member such as a rope 132 or the like.

It should be readily apparent to those skilled in the art that the mast support 122 functions in substantially the same manner as the mast support 22 described in more detail above. Furthermore, each of the component parts of the mast support 122 is intended to function in substantially the same manner as its corresponding part in mast support 22.

The present invention may be embodied in other specific forms without departing from the spirit or essential attributes thereof and accordingly reference should be made to the appended claims rather than to the foregoing specification as indicating the scope of the invention.

I claim:

1. In a sailboat having a mast and a boom, the improvement comprising:

a mast support for supporting the lower end of said mast, said mast support including substantially rigid and immovable side and rear walls and a partial lower front wall but otherwise being substantially open at the front thereof, said walls being spaced apart a sufficient distance to allow said mast to be freely moved in a vertical direction into and out of said support, said rear wall being lower than said side walls and terminating in an upper edge which can support said mast for pivotal and slideable motion;

a base plate secured to the bottom of said walls for mounting said mast support on the deck of the boat;

means associated with said base plate and located within said mast support and cooperating with said mast to prevent lateral movement of the bottom of said mast relative to said base plate;

means connecting the forward upper ends of said mast support side walls together;

means carried on the outer surface of said mast support rear wall for securing the forward end of the boom thereto;

whereby a mast supported in a vertical position by said mast support is lowered by first lifting the same slightly until the bottom no longer cooperates with said base plate and then tilting the mast backward where it rests and pivots on the upper edge of the rear wall as the bottom of the mast pivots upwardly above said partial lower front wall and through the opening at the front of the mast support.

2. The invention as claimed in claim 1 wherein said mast is substantially tubular and wherein said means associated with said base plate is a mast plate mounted on said base plate, the outer dimensions of said mast plate being complementary to but smaller than the inner dimension of the bottom of said mast so that the mast can fit over said mast plate.

3. The invention as claimed in claim 1 wherein said mast support is substantially tubular but is substantially open at the front thereof.

4. The invention as claimed in claim 3 wherein said connecting means is comprised of a partial front upper wall of said substantially tubularly shaped mast support.

5. The invention as claimed in claim 4 wherein said means for securing said boom is capable of connecting the same in any one of a plurality of different vertical positions.

6. The invention as claimed in claim 1 wherein said rear, front and side walls are substantially planar whereby the configuration of said mast support is substantially box-shaped.

7. The invention as claimed in claim 6 wherein said connecting means is substantially flexible.

8. The invention as claimed in claim 7 wherein said means for securing said boom is capable of securing the same in any one of a plurality of different vertical positions.

* * * * *